US008322099B2

(12) United States Patent
Reid

(10) Patent No.: US 8,322,099 B2
(45) Date of Patent: Dec. 4, 2012

(54) APPARATUS, ASSEMBLY AND METHOD OF FORMING A DECORATIVE FEATURE ON A STRUCTURE

(76) Inventor: David Michael Reid, Glasgow (GB)

( * ) Notice: Subject to any disclaimer, the term of this patent is extended or adjusted under 35 U.S.C. 154(b) by 326 days.

(21) Appl. No.: 12/303,606

(22) PCT Filed: Jun. 6, 2007

(86) PCT No.: PCT/GB2007/002077

§ 371 (c)(1),
(2), (4) Date: Oct. 11, 2010

(87) PCT Pub. No.: WO2007/141521

PCT Pub. Date: Dec. 13, 2007

(65) Prior Publication Data

US 2011/0041439 A1 Feb. 24, 2011

(30) Foreign Application Priority Data

Jun. 6, 2006 (GB) ..... 0611077.9
Nov. 30, 2006 (GB) ..... 0623957.8

(51) Int. Cl.
*E04F 13/09* (2006.01)

(52) U.S. Cl. ..... 52/387; 52/314

(58) Field of Classification Search ..... 52/387, 52/386, 388, 384, 389, 314
See application file for complete search history.

(56) References Cited

U.S. PATENT DOCUMENTS

| | | | | |
|---|---|---|---|---|
| 1,861,359 | A * | 5/1932 | Pyron | 52/387 |
| 4,026,083 | A * | 5/1977 | Hoyt et al. | 52/387 |
| 4,761,926 | A | 8/1988 | Rea et al. | |
| 5,855,075 | A | 1/1999 | DiGiovanni | |
| 6,164,037 | A * | 12/2000 | Passeno | 52/749.11 |
| 6,802,165 | B1 * | 10/2004 | Passeno | 52/387 |
| D625,846 | S * | 10/2010 | Scott | D25/199 |
| 2003/0208978 | A1 * | 11/2003 | Chen | 52/483.1 |
| 2004/0050003 | A1 | 3/2004 | Passeno | |
| 2006/0201092 | A1 * | 9/2006 | Saathoff et al. | 52/385 |
| 2009/0019793 | A1 * | 1/2009 | Huber, Jr. | 52/101 |

FOREIGN PATENT DOCUMENTS

| | | |
|---|---|---|
| DE | 2816769 | 10/1979 |
| DE | 202 12 655 U1 | 10/2002 |
| EP | 0 825 311 A2 | 2/1998 |
| FR | 2612546 | 9/1988 |
| GB | 2 231 890 A | 11/1990 |
| GB | 2 391 024 A | 1/2004 |

* cited by examiner

*Primary Examiner* — Christine T Cajilig
(74) *Attorney, Agent, or Firm* — Dickinson Wright PLL

(57) ABSTRACT

There is disclosed apparatus for use in forming a decorative feature on a structure, and a method of forming a decorative feature on a structure. In an embodiment of the invention, apparatus (10) for use in forming a decorative feature on a structure such as a building is disclosed. The apparatus (10) comprises a support adapted to be mounted on a surface of a structure, the support having a planar outer face (23, 25) for receiving a decorative element (26, 28), for thereby mounting the decorative element (26, 28) on the surface of the structure to form a decorative feature; and at least one set of mounting elements (42, 44) provided on the outer face (23, 25) of the support (10); wherein the mounting elements (42, 44) in the/each set together define an at least one mounting area (22, 24) on the support outer face (23, 25), which mounting area is shaped to receive a decorative element (26, 28); and wherein the mounting elements (42, 44) define at least one border of the mounting area (22, 24) to facilitate positioning of the decorative element (26, 28) on the support outer face (23, 25).

24 Claims, 14 Drawing Sheets

FIG. 16
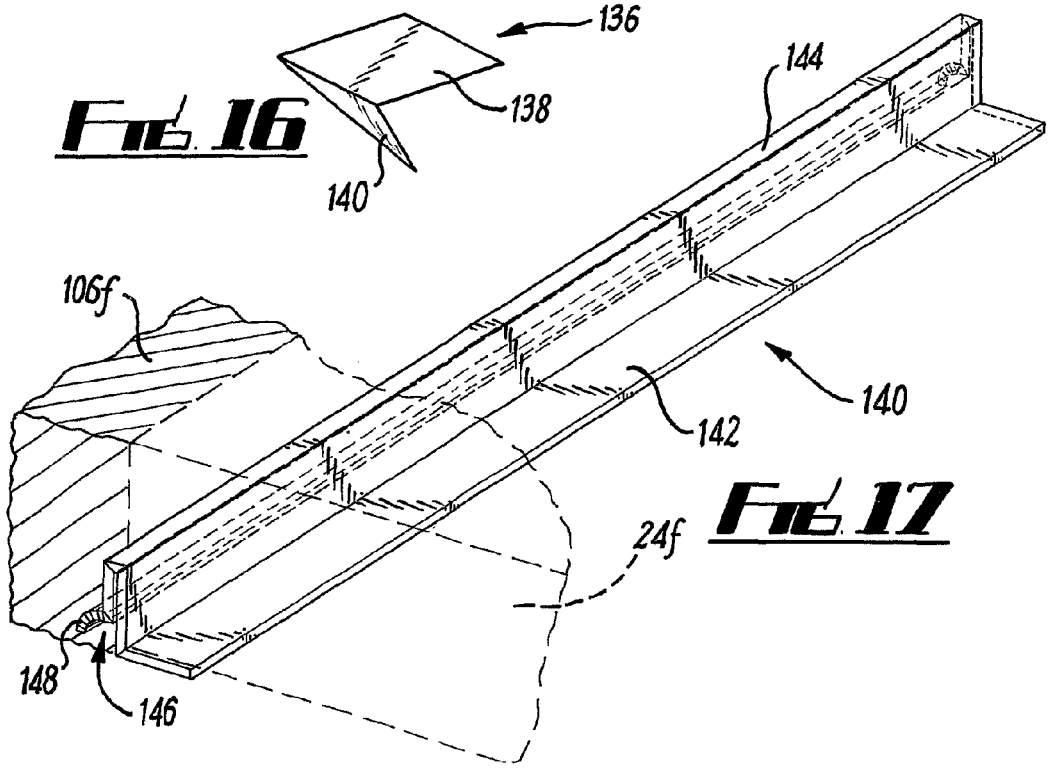
FIG. 17
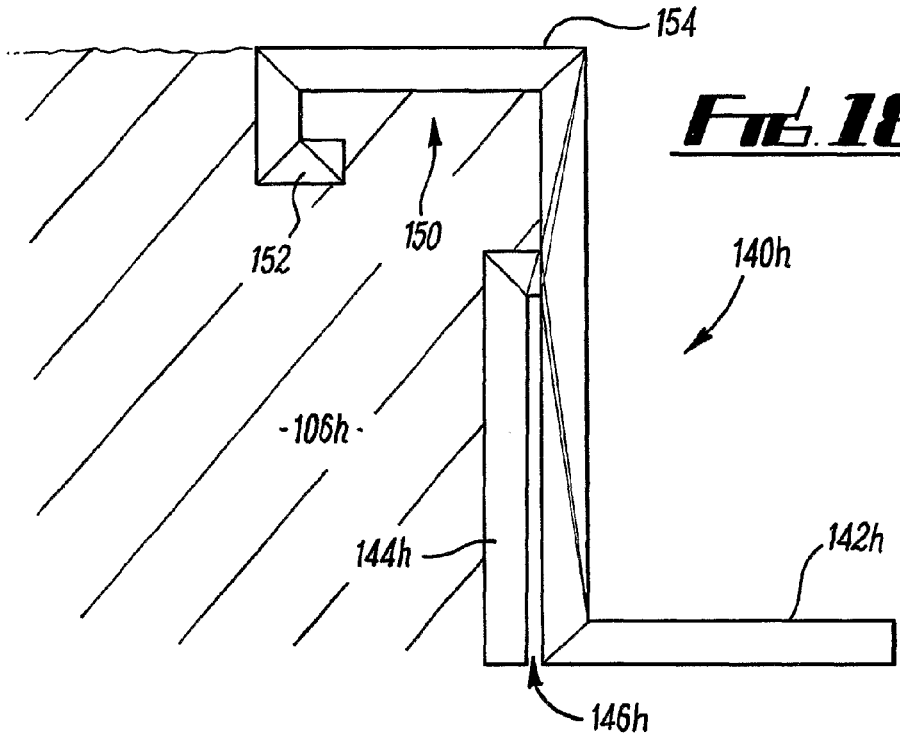
FIG. 18

APPARATUS, ASSEMBLY AND METHOD OF FORMING A DECORATIVE FEATURE ON A STRUCTURE

CROSS REFERENCE TO RELATED APPLICATIONS

The present application is a 35 U.S.C. §371 national stage filing of International Patent Application No. PCT/GB2007/002077, filed Jun. 6, 2007, and through which priority is claimed to Great Britain Patent Application No. 0623957.8, filed Nov. 30, 2006, and Great Britain Patent Application No. 0611077.9, filed Jun. 6, 2006.

The present invention relates to apparatus for use in forming a decorative feature on a structure, and to a method of forming a decorative feature on a structure. In particular, but not exclusively, the present invention relates to apparatus for use in forming a decorative feature on a building, and to a corresponding method.

Insulation systems for cladding buildings in order to, inter alia, reduce heat loss, improve resistance to water penetration, reduce the effects of frost damage, and to provide a decorative finish, are well known.

One such insulation system involves fixing insulating brick cladding panels to the wall of a building using mechanical fixings. These panels typically include a foam insulating material of around 50-75 mm in thickness, which carries a backing sheet that is placed adjacent the building wall. During manufacture, a number of decorative 'briquettes' or 'slips' are fixed to external surfaces of the panels, and provide a finished appearance alike to a conventional brick wall.

In an alternative system, an insulating render panel is fixed to a building wall and is subsequently rendered with a decorative cement-based coating. Before the render coating can be applied, the outer surface of the insulating material is coated with a base adhesive, and a nylon or glass-fibre mesh is secured to the surface using the adhesive. The adhesive protruding through the mesh is then trowelled smooth and allowed to cure before applying the final surface render coating. These systems are commonly known as insulated render systems.

As will be described below, in some cases, a finished surface having a number of decorative briquettes and rendered areas may be provided.

Insulating brick cladding panels are commercially available under the ISOSYSTEM and ISOLINKER Trade Marks, and typically come in sheets of 1 m×1.5 m in dimensions carrying briquettes or slips that are shaped to provide a desired finish. For example, the panels are available in patterns which replicate traditional 'stretcherbond', 'stackbond' and 'herringbone' patterns. Also, the briquettes are of similar size to conventional bricks and may be around 215 mm×65 mm for the UK, 240 mm×66 mm for Europe and, in each case, around 10-20 mm deep.

Typically, when installing insulation panels, it is necessary to first measure the building walls and then cut the panels to a required shape to fit the surface in question, and/or to provide a desired finished effect. For insulating brick cladding panels, this work is typically carried out in a workshop, offsite from the building when corner sections and window 'reveals' are required; insulating render panels are typically cut to size on site. The process of cutting the panels to shape involves significant material wastage as the sections of the panel that are removed cannot be reused and are disposed of. Additionally, the panels (particularly the insulating brick cladding panels) are heavy and bulky, adding to storage and transportation costs.

Whilst such insulating brick cladding and insulating render based insulation systems are each separately effective in, inter alia, providing good decorative surface finishes, and in improving the insulation and weather resisting properties of the building in question, there are limitations in that the panels cannot easily be used to replicate certain surface finishes. For example, referring to FIG. 19, which is a perspective view of a typical mid 20$^{th}$ century house 1 in the UK, many older houses were built with decorative brick finishes including 'quoining' details 2*a*, 2*b*; window edging 3*a*, 3*b*; door edging 4*a*, 4*b*; lines 5*a*, 5*b* extending around or up the walls of the building; under-eave lines 6; and/or diamonds 7. These decorative features were all conventionally created by leaving some of the bricks used to form the building walls 8, 9 standing slightly proud of the wall surface during construction. The remainder of the house walls 8, 9 were then coated with a suitable weather-resistant render finish.

Such decorative effects, combining brick and render finishes, are difficult and time-consuming to reproduce with existing insulation systems. For example, following the techniques described above, this is currently achieved by first applying the insulated brick cladding panels to the building walls to form the desired effects. This involves cutting the panels to the required size (with large material wastage) and fixing the panels to the house walls. Subsequently, the insulating render panels are cut to size to fit in around the insulating brick panels previously fixed to the walls, which is time-consuming and also involves significant material wastage. After the render panels have been secured in place, the render panels are coated with adhesive and a mesh before the final render coating is applied, as described above. It has been found that the finished effect is somewhat diminished as the render is usually in the same plane as the outer surfaces of the briquettes, such that the briquettes do not stand proud of the surface. It will be understood that similar problems are encountered where such features are to be produced in a new-build house, or on a previously unadorned house.

Additional problems are encountered where existing decorative features proud of a wall surface are to be overlaid either with insulating brick or insulating render panels, as some remedial work must be carried out to make the surface sufficiently level, before the panels can be applied.

It is amongst the objects of at least one embodiment of the present invention to obviate or mitigate at least one of the foregoing disadvantages.

According to a first aspect of the present invention, there is provided apparatus for use in forming a decorative feature on a structure, the apparatus adapted to be mounted on a surface of a structure and defining at least one mounting area shaped to receive a decorative element, for mounting the decorative element on the surface of the structure, to thereby form a decorative feature.

According to a second aspect of the present invention, there is provided apparatus for use in forming a decorative feature on a structure, the apparatus comprising:

a support adapted to be mounted on a surface of a structure, the support having a planar outer face for receiving a decorative element, for thereby mounting the decorative element on the surface of the structure to form a decorative feature; and at least one set of mounting elements provided on the outer face of the support;

wherein the mounting elements in the/each set together define an at least one mounting area on the support outer face, which mounting area is shaped to receive a decorative element;

and wherein the mounting elements define at least one border of the mounting area to facilitate positioning of the decorative element on the support outer face.

It will be understood that the apparatus may be for use in forming a decorative feature on a building such as a house, or indeed on any other suitable structure including bridges, free-standing walls, tunnel walls and the like. Equally, the decorative element may be a decorative building element.

Preferably, the apparatus is for use in forming a decorative simulated brick feature on the surface of the structure.

The invention provides apparatus which can be mounted on any surface of a structure and thus, for example, on an insulating panel fixed to an existing wall of a building. Accordingly and in contrast to current insulating systems, it is therefore not necessary to cut insulating panels to fit around the decorative feature.

The apparatus may comprise a plurality of mounting areas. At least one of the mounting areas may be provided within a perimeter of the support outer face, to facilitate positioning of the decorative element within the perimeter of the support outer face. The mounting elements may define a plurality of borders of the mounting area, and may define at least one of an upper, lower, left side and right side border of the mounting area. However, it will be understood that the borders defined by the mounting elements will depend upon the shape of the mounting area and the location of the support on the structure surface, in use. At least one set of the mounting elements may define all of the borders of the respective mounting area.

Additionally or alternatively, at least one set of mounting elements defines some (but not all) of the borders of the mounting area, and the support may be adapted to cooperate with a set of mounting elements in an adjacent support for mounting a decorative element on the surface of the structure.

The apparatus may comprise a plurality of sets of mounting elements, each set of mounting elements defining a respective mounting area. Each mounting element may extend from the outer (in use) surface of the apparatus, and may be a projection such as a tab, arm or finger.

Alternatively, the support may comprise a frame defining the or each set of mounting elements, the frame being raised relative to or upstanding from the outer face of the support and defining the at least one mounting area. The frame may define the borders or a perimeter of the mounting area. The frame may comprise a number of strips, ribs or the like, which together form the frame. The frame may be continuous, that is, without any gaps or breaks in the frame, or discontinuous, that is with gaps.

In a further alternative, the support comprises at least one recess, the recess formed in the outer face of the support, side walls of the recess defining the mounting elements and thus the recess forming the mounting area.

It will be understood that providing mounting elements, a frame or a recess which forms the mounting area may facilitate mounting of the decorative element on or in the support.

The frame and/or recess may define a plurality of walls extending in a direction transverse to a main plane of the support and the walls may define one or more borders or a perimeter of the mounting area.

Preferably, the support comprises a plurality of mounting areas, each mounting area shaped to receive a respective decorative element. Thus a pattern formed from a plurality of decorative elements may be formed on the structure surface. It will be understood that where the support comprises a frame, the frame may define the plurality of mounting areas. Alternatively, the support may comprise a plurality of frames, each frame defining a respective at least one mounting area. In a further alternative, where the support comprises a recess forming the mounting area, the support may comprise a plurality of recesses, each recess defining a respective at least one mounting area.

The apparatus may be adapted to receive and engage the decorative element. To achieve this, the apparatus may be shaped to receive the decorative element in an interference fit. The mounting elements may be adapted to receive and engage the decorative element in an interference fit. At least one of the mounting elements may extend into the mounting area and may be at least partly deformable, preferably elastically deformable, for receiving and engaging a decorative element. This may facilitate location of decorative elements of varying dimensions within the mounting area, and may account for manufacturing variations in the decorative elements. The at least one mounting element may comprise a deformable portion adapted to deform on location of a decorative element in the mounting area.

Where the apparatus comprises a frame defining the at least one mounting area, the frame may have walls adapted to receive and engage the decorative element in an interference fit. To achieve this, at least part of the mounting elements or of a wall or walls of the frame may be inclined or tapered to provide a push-fit engagement with the decorative elements. Alternatively or in addition, the mounting elements or the frame may comprise at least one engaging member, such as a tab, pin, latch, arm or the like, for engaging the decorative element. It will be understood that where the support comprises a recess defining the mounting area, walls of the recess may be similarly shaped, and/or the support may comprise such an engaging member.

The support may comprise at least one aperture, the aperture formed within the mounting area. This may facilitate formation of the decorative feature by permitting direct bonding of the decorative element to the structure surface through the support, using a suitable adhesive. The support may comprise a plurality of such apertures, one for each decorative element to be used to form the decorative feature. The aperture may be smaller than the mounting area to define an overlap of the decorative element with the support, in use, such that the decorative element may be bonded to the support using a suitable adhesive. A mesh or grid may be provided extending across the aperture, which may be integral with, that is, formed as part of the support, or which may be a separate member coupled to the support. This may permit an enhanced fixing of the decorative element to the structure surface. This is because, should a bond formed between the support and the surface fail, the decorative element would remain fixed to the wall by virtue of engagement with the support, which may be mechanically or otherwise mounted on the wall using fixings or the like. However, in a preferred embodiment, the apparatus comprises a plurality of apertures arranged in a mesh or grid.

The apparatus may comprise a plurality of locating members, such as elongate beads or the like, the locating members adapted to be mounted on an at least one mounting element and to cooperate with a decorative element, for facilitating mounting of the decorative element on the support. The locating members may also comprise a lip portion adapted to overlie an edge of the support and to interact with a render or other coating applied to the structure surface, for facilitating mounting of the support on the surface of the structure. In this fashion, once the render overlying the lip portion hardens, the support is securely bonded to the structure surface. The locating members may also comprise a portion adapted to receive a decorative element, for securing the locating member on to the or each mounting element and thus to the support.

The apparatus may comprise a plurality of adhesive passages or channels extending between an internal and an external (in use) surface thereof. This may facilitate an improved bond of the apparatus to a structure surface by permitting flow of a mounting adhesive through the passages from the internal to the external surface. The adhesive may, in use, be extruded from an outlet of the passage on the external surface during mounting of the apparatus on the surface (which may be an air release outlet), forming a cap or button following setting of the adhesive, and thereby providing an enhanced bond (whilst allowing trapped air to escape).

The support may comprise at least one channel on an internal surface thereof, said channel being for receiving an adhesive used to bond the support to the structure surface. This may restrict wastage of adhesive. The adhesive passages may optionally open onto the channel.

The apparatus may be foldable, which may permit formation of a decorative feature extending around a corner of a structure such as the corner of a building. To facilitate this, the apparatus may comprise one or more lines of weakness, grooves, channels, creases or the like about which it may fold.

The support may be modular and may comprise a plurality of support sections, and each support section may define an at least one mounting area. The support sections may be coupled by a frangible joint, connection or tear-strip. This may facilitate separation of the support into smaller support sections, and may enable formation of decorative features of different sizes and shapes from a basic support.

The apparatus may comprise at least one alignment marker or the like, for facilitating alignment with a further such apparatus; an existing feature of the building; and/or a locating mark formed on the wall. The support may comprise an engaging element for coupling the support to a further such support. The support may comprise at least one male and at least one female engaging element for permitting such coupling; the engaging elements may be tongue-and-groove type elements.

The apparatus may comprise a mounting aperture for receiving a fixing by which the apparatus may be mounted on the wall. This may permit use of the apparatus with proprietary fixings approved for use with insulated render systems or the like. The mounting aperture may be formed or provided in a border area of the apparatus and thus outside the mounting area, or may be formed or provided in the mounting area. Where the mounting aperture is formed in the mounting area, a fixing used to mount the apparatus on the surface may be located behind the decorative element, in use. In an alternative, the apparatus may comprise integral fixings.

According to a third aspect of the present invention, there is provided an assembly for use in forming a decorative feature on a structure, the assembly comprising:

at least one decorative element;

a support adapted to be mounted on a surface of a structure, the support having a planar outer face for receiving the decorative element, for thereby mounting the decorative element on the surface of the structure to form a decorative feature when the support is mounted on the structure surface; and at least one set of mounting elements provided on the outer face of the support;

wherein the mounting elements in the/each set together define an at least one mounting area on the support outer face, which mounting area is shaped to receive the decorative element;

and wherein the mounting elements define at least one border of the mounting area to facilitate positioning of the decorative element on the support outer face.

The assembly may comprise a plurality of supports, and may comprise a first support, and a second support adapted to be located adjacent the first support. An at least one set of mounting elements of the first support may define at least one border of a mounting area of the first support, and an at least one set of mounting elements of the second support may define at least one border of a mounting area of the second support. In use, a decorative element may be adapted to be located partly in said mounting area of the first support and partly in said mounting area of the second support. Accordingly, the decorative element may bridge across from the first support to the second support.

Further features of the support and of the decorative element are defined above in relation to the first and second aspects of the invention.

Preferably, the building assembly comprises a plurality of decorative elements. The support may define a plurality of mounting areas, each mounting area adapted to receive a respective at least one decorative element. In embodiments of the invention, each mounting area may be shaped to receive a plurality of decorative elements.

According to a fourth aspect of the present invention, there is provided a method of forming a decorative feature on a structure, the method comprising the steps of:

mounting a support on a surface of a structure; and mounting an at least one decorative element in an at least one mounting area of the support shaped to receive the at least one decorative element, to thereby form a decorative feature on the structure.

According to a fifth aspect of the present invention, there is provided a method of forming a decorative feature on a structure, the method comprising the steps of:

mounting a support having a planar outer face for receiving a decorative element on a surface of a structure;

providing an at least one set of mounting elements on the outer face of the support, the mounting elements in the/each set together defining an at least one mounting area which is shaped to receive a decorative element, the mounting elements also defining at least one border of the mounting area to facilitate positioning of the decorative element on the support; and mounting the decorative element in the mounting area to thereby form a decorative feature on the structure.

The decorative element may be provided within a perimeter of the outer face such that, when the decorative element is mounted in the mounting area, the decorative element is within the perimeter of the outer face.

Alternatively, the method may comprise mounting a first support on the surface of the structure, and a second support adjacent the first support. A decorative element may then be located partly in a mounting area of the first support and partly in a mounting area of the second support, and the decorative element may thus bridge across from the first support to the second support. Further supports may be mounted on the surface of the structure and decorative elements mounted bridging across adjacent supports as described above. It will be understood that the supports may be mounted immediately adjacent one-another and thus with little or no gap in between or in abutment, or a gap may exist between the supports.

The method may be a method of forming a decorative feature on a building, such as a house, or indeed on any other suitable structure including a bridge, a free-standing wall, a tunnel wall or the like. The method may comprise mounting an at least one decorative building element in the support mounting area.

The method may comprise mounting the support on the surface of the structure and then mounting the at least one decorative element in the mounting area. This may facilitate handling of the support and alignment of the support with the surface. Alternatively, the at least one decorative element may be mounted in the mounting area of the support prior to mounting of the support on the surface. This may reduce work required to be carried out on-site, by premounting the decorative elements to the support.

The method may comprise locating a plurality of insulating panels on the structure surface prior to mounting the support on the surface. Accordingly, the support may be mounted on an external surface of the insulating panel. In this fashion, the requirement of conventional insulating systems whereby insulating panels must be subsequently cut to fit around the decorative feature, is avoided.

Embodiments of the present invention will now be described, by way of example only, with reference to the accompanying drawings, in which:

FIG. 16 is an enlarged view of a shaped mounting tab forming part of the apparatus of FIG. 15;

FIG. 17 is a perspective view of a locating member, in the form of an elongate bead, for use with any of the supports of FIGS. 9 to 15;

FIG. 18 is an end view of an alternative locating member, in the form of an elongate bead, for use with any of the supports of FIGS. 9 to 15.

Figure 1:
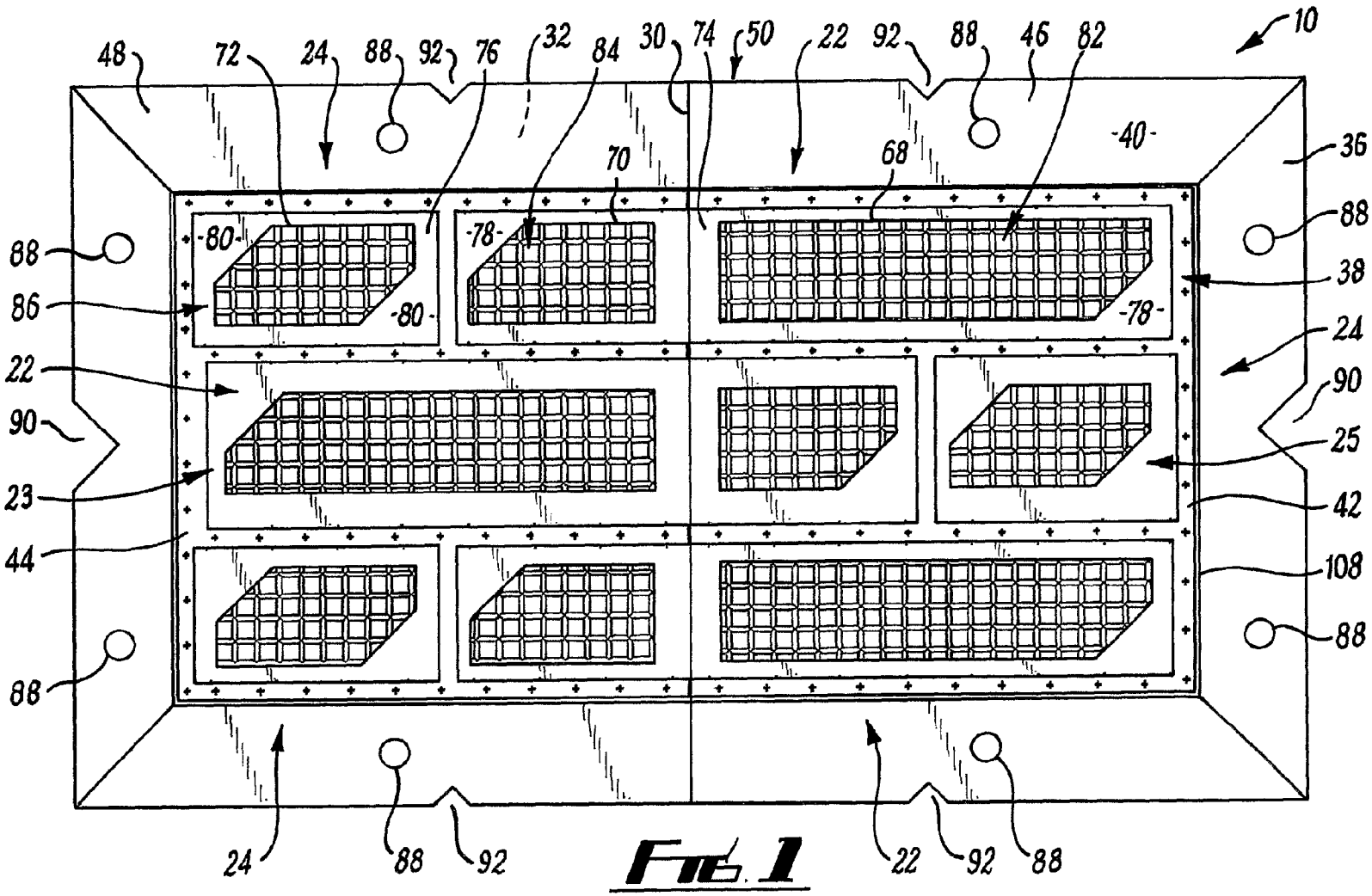
FIG. 1 is a front view of apparatus for use in forming a decorative feature on a structure, in accordance with an embodiment of the present invention.
Figure 2:
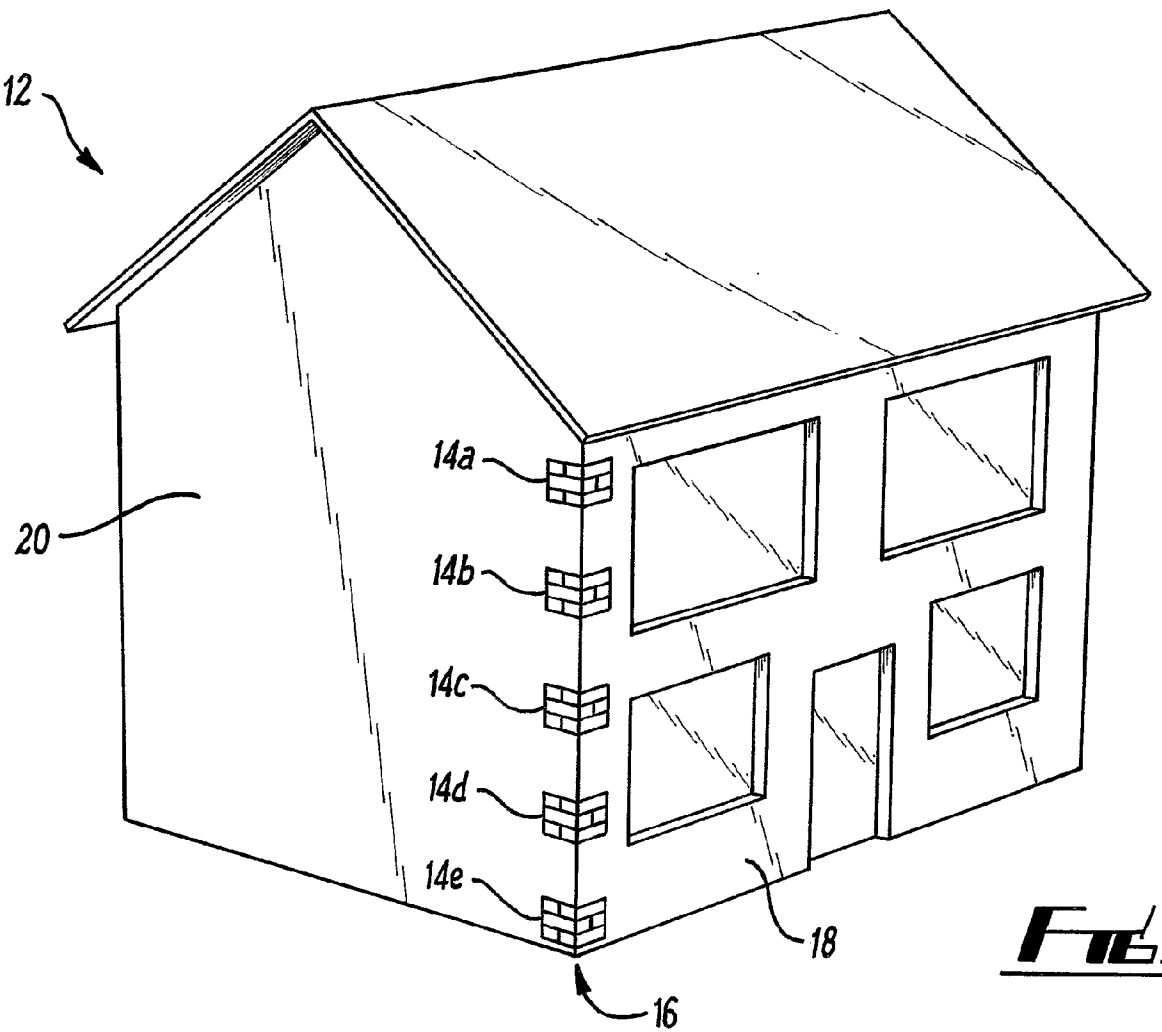
FIG. 2 is a perspective view of a structure including a number of decorative features to be formed using the apparatus of FIG. 1.

Turning firstly to FIG. 1, there is shown apparatus for use in forming a decorative feature on a surface of a structure, the apparatus indicated generally by reference numeral 10. FIG. 2 is a perspective view of a structure in the form a building, particularly a house 12, which illustrates a number of decorative features in the form of quoining details 14*a* to 14*e*. These quoining details are provided on a corner 16 of the house 12, extending around a front wall (surface) 18 to a side wall 20 (surface) of the house 12. It will be understood that each of the quoining details 14*a* to 14*e* is formed using the apparatus 10.

The apparatus 10 shown in FIG. 1 comprises or takes the form of a support defining at least one mounting area and, in the illustrated embodiment, defines a number of mounting areas 22 and 24 provided on planar outer faces 23 and 25 of the support 10. The mounting areas 22 and 24 are shaped to receive decorative building elements in the form of briquettes or slips which, in the finished quoining detail 14, provide a surface finish alike to that which would be produced using conventional bricks laid out in a stretcherbond pattern. Clay slips or briquettes 26 and 28 are shown mounted in the respective mounting areas 22 and 24 in FIG. 3, which is a perspective view of the support 10 following folding of the support, which will now be described.

Figure 5:
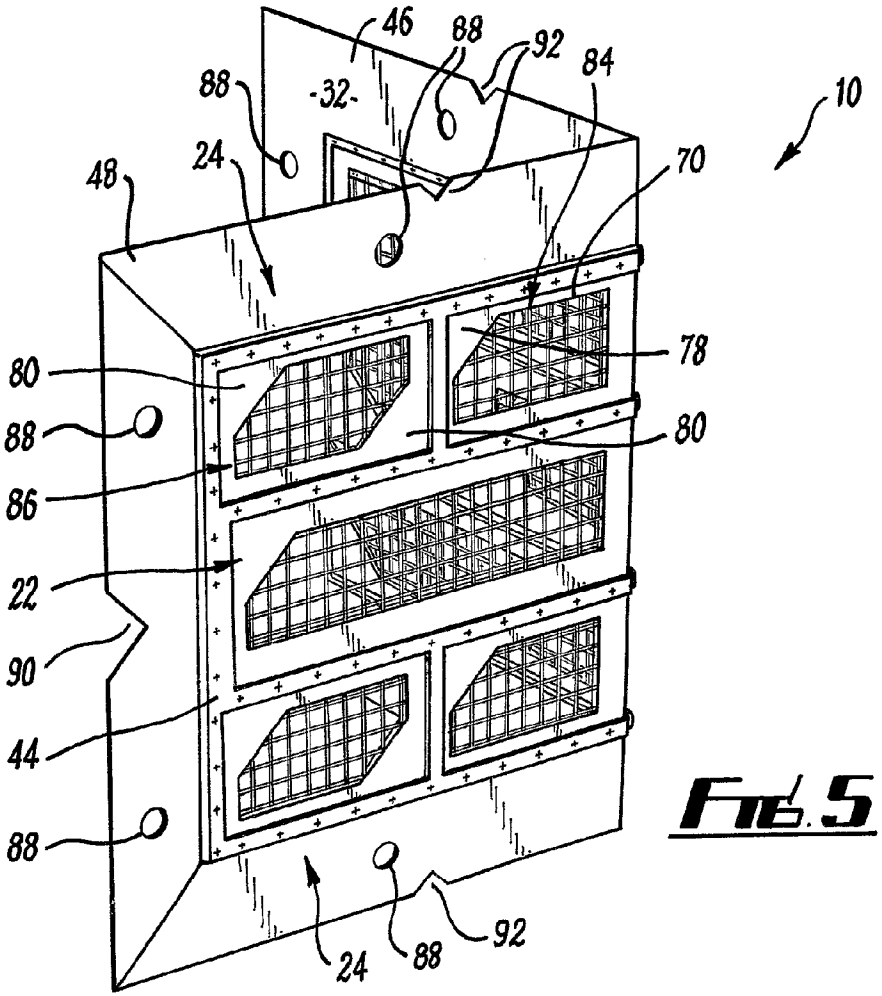
Figure 6:
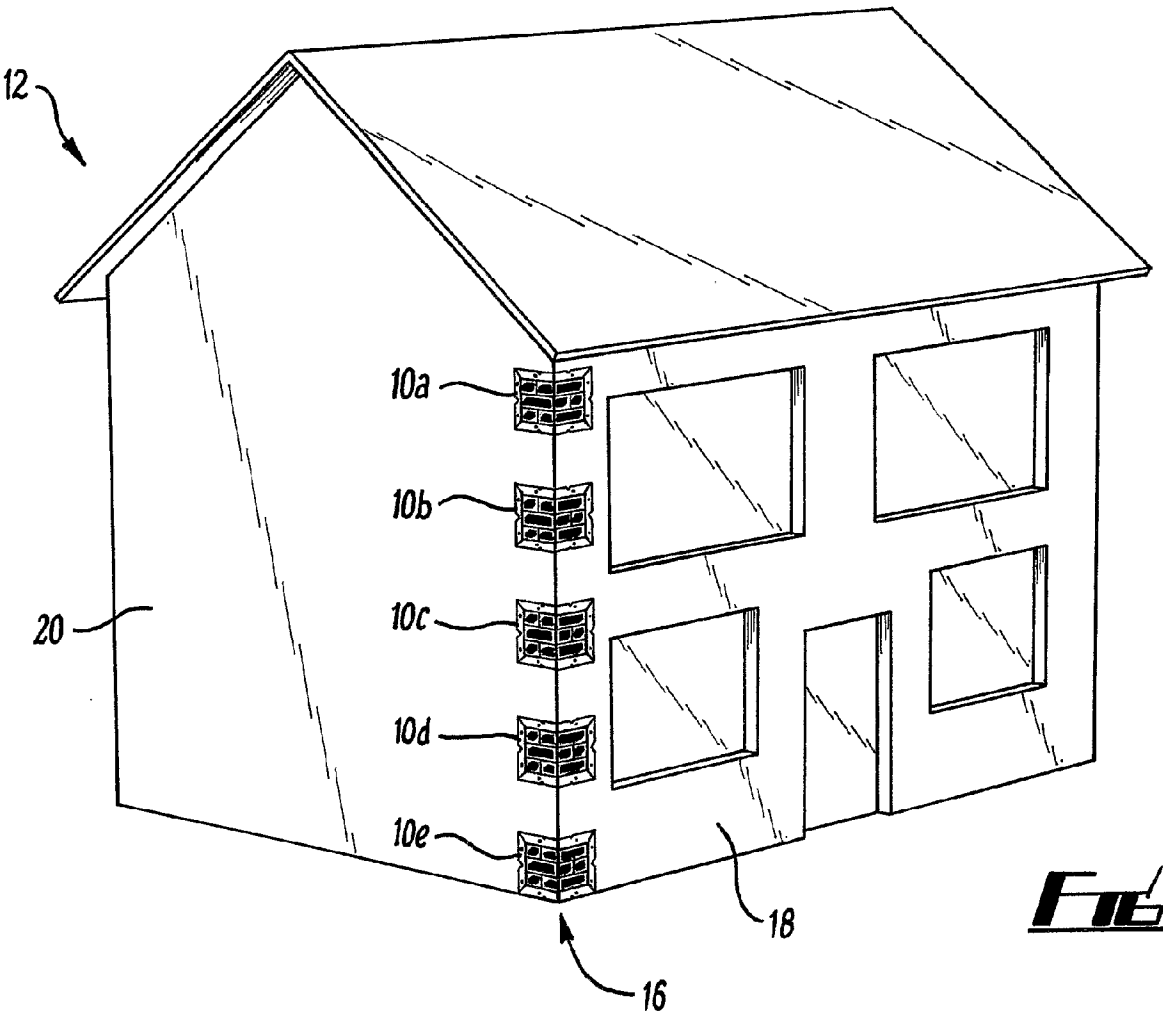
FIG. 6 is a view of the structure shown in FIG. 2, with a number of the FIG. 1 apparatus mounted on the structure and shown prior to the mounting of decorative elements in the mounting areas of each apparatus.

As shown in FIG. 1, the support 10 includes a crease or fold line 30 which is formed by creating a recess or channel (not shown) in a rear or internal surface 32 of the support 10. The support 10 folds about the crease 30, as shown in the perspective views of FIGS. 4 and 5, which are taken from different angles. It will be understood that following folding of the support 10 in this fashion, the support 10 may be located extending around the corner 16 of the house 12. FIG. 6 illustrates the house 12 following location of a number of the supports 10*a* to 10*e* on the house corner 16.

Following positioning of the supports 10*a* to 10*e* on the house 12 in this fashion, the clay slips 26 and 28 are secured in position within the mounting areas 22 and 24. The house walls 18 and 20 are then finished with a render coating, which will be described in more detail below, and the channels 34 between the clay slips 26 and 28 are filled with a suitable mortar grout. In an alternative method, the clay slips 26 and 28 are mounted in the mounting areas 22, 24 of the folded supports 10 prior to location on the house corner 16.

The support 10 will now be described in more detail.

Figure 4:
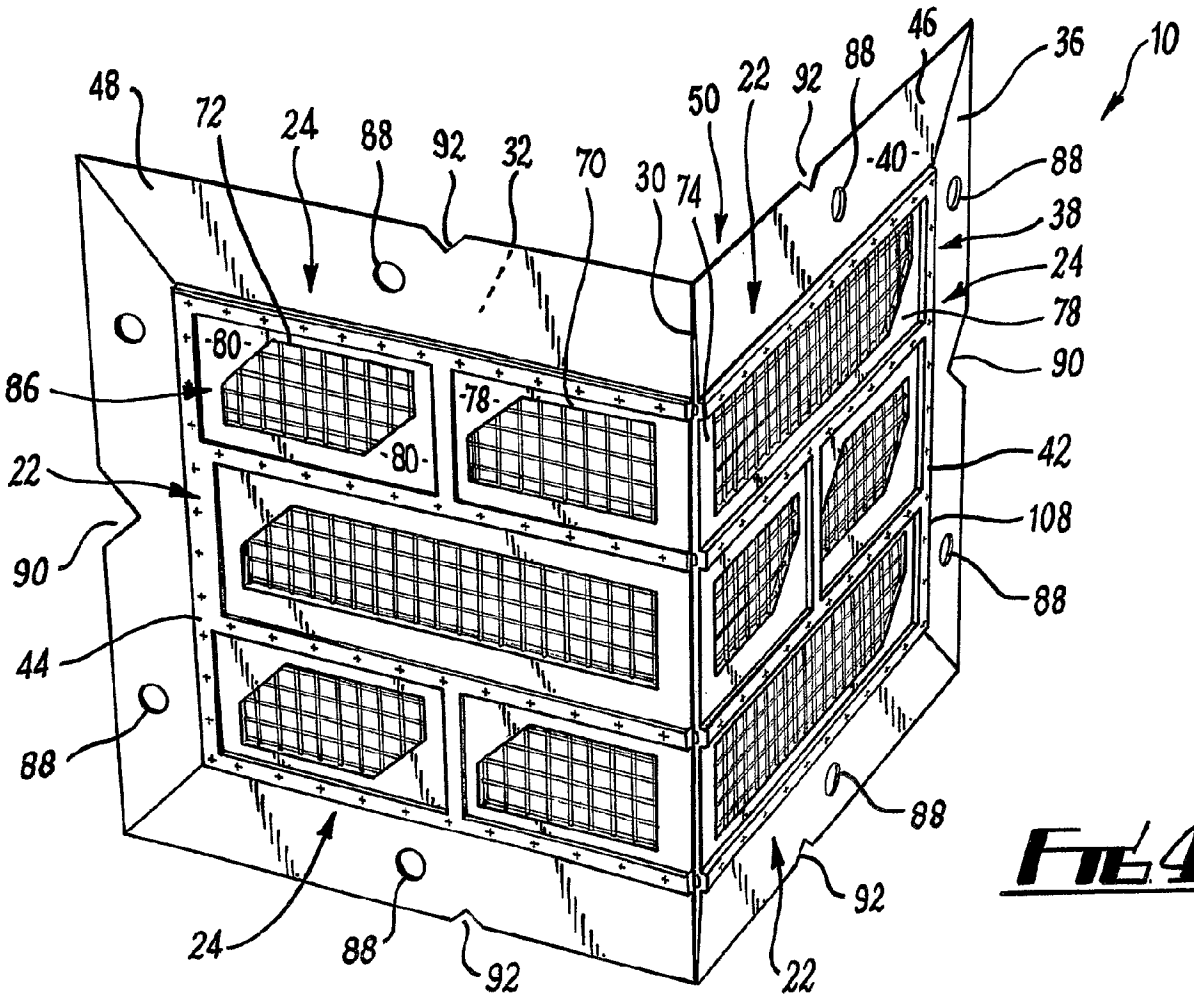
FIGS. 4 and 5 are perspective views of the apparatus shown in FIG. 1, taken from different angles.

As shown particularly in FIG. 1, the support 10 comprises a generally flat panel 36. A frame 38 protrudes from a front or external surface 40 and comprises two strips 42 and 44, the strip 42 formed on a right half 46 of the panel 36 and the strip 44 on a left half 48. As shown in FIGS. 4 and 5, this permits the support 10 to fold about the crease 30.

Figure 7:
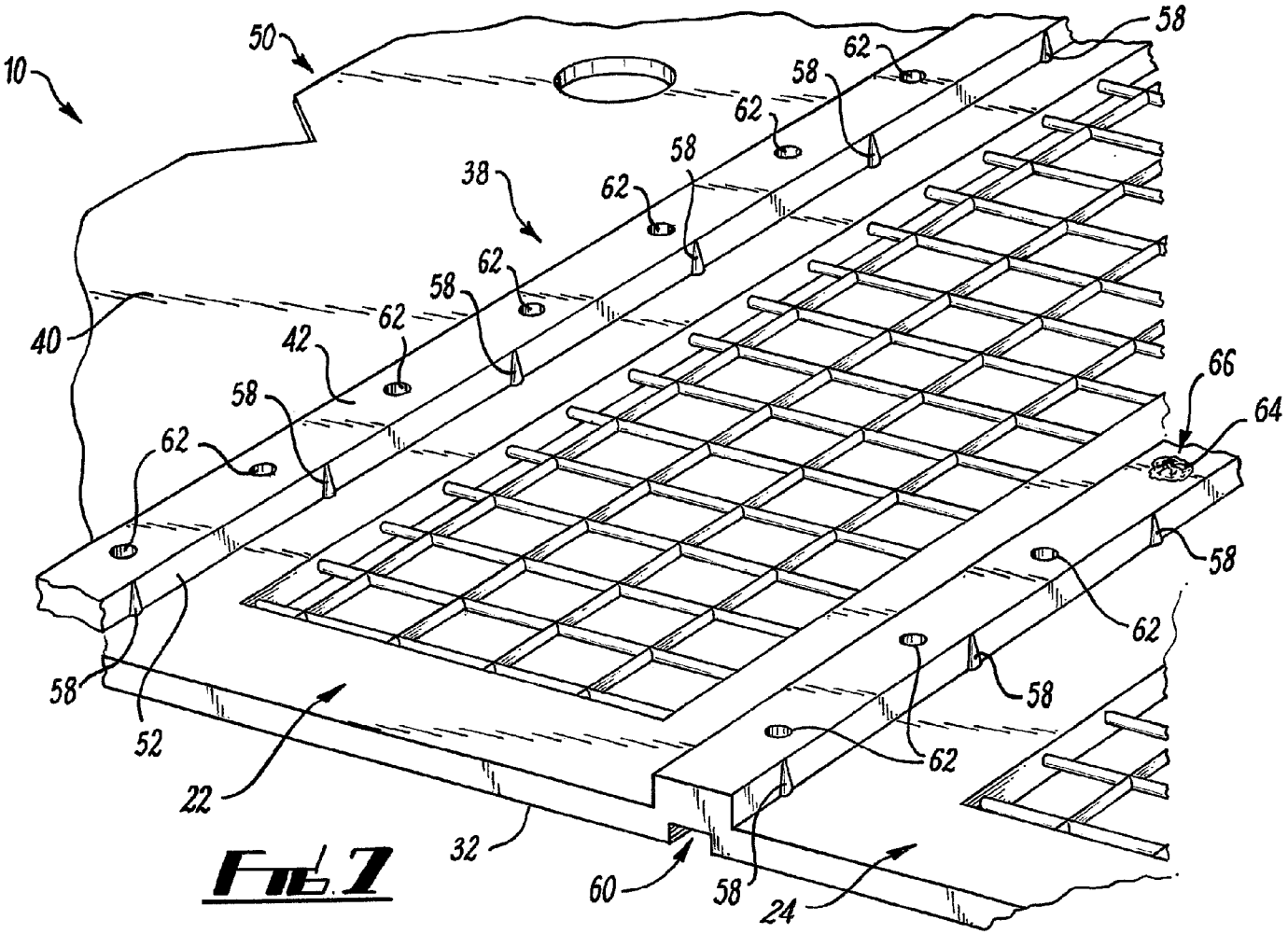
FIG. 7 is an enlarged, perspective view of part of the apparatus shown in FIG. 1.

The structure of the strip 42 on the right half 46 of the panel 36 is shown in more detail in FIG. 7, which is an enlarged perspective view of an upper left hand area 50 (FIG. 1) of the panel 36. As shown, the strip 42 includes side walls 52 which define the borders/perimeters of the mounting areas 22 and 24, and which provide abutment surfaces for edges 54 and 56 (FIG. 3) of the clay slips 26 and 28. Additionally, engaging elements in the form of tapered wedges 58 are provided at spaced locations along the length of the strip 42, to define an interference or engaging push-fit with the slips 26 and 28. This provides a degree of retention of the slips 26 and 28 to the support 10 independent of any adhesive which is used, and aids in formation of the quoining details 14.

The strip 42 is typically formed integrally with the panel 36 by injection moulding the support 10 from a suitable plastics material such as polyethylene or other suitable material and manufacturing process. Channels or grooves 60 are formed in the internal surface 32 of the panel 36 following a path corresponding to the location of the strip 42. During fitting of the supports 10 to the house 12, an adhesive is supplied into the channels 60 and the support is then pressed against the house walls 18, 20. These channels 60 provide an improved bond with the house 12 and also assist in avoiding excessive use of adhesive and thus material wastage.

A number of passages 62 are provided extending through the strip 42, opening at the internal surface 32 onto the channels 60, and opening onto the external surface 40. These passages 62 provide for the flow of adhesive during press-fitting of the supports 10 on the house 12, and the release of air trapped between the support 10 and the house wall. As shown in FIG. 7, the adhesive 64 is extruded through the passages 62 and forms a dome or cap 66 on the external surface of the strips 42 on curing, to provide an enhanced engagement of the supports 10 on the house 12.

It will be understood that the strip 44 on the left half 48 of the panel 36 is constructed in a similar fashion to the strip 42 described above.

Apertures 68 and 70 are provided extending through the panel 36 in the mounting areas 22, and similar apertures 72 are provided in the mounting areas 24. During fitting of the clay slips 26 and 28 to the support 10, an adhesive is applied to rear surfaces of the slips. It will therefore by understood that by providing such apertures 68, 70 and 72, a direct bond between the slips 26 and 28 and the house walls 18, 20 can be achieved. Additionally, the apertures 68, 70 and 72 are sized such that the slips 26 and 28 can be bonded directly to the external surface 40 of the support 10 in border regions 74 and 76 of the mounting areas 22 and 24. Additionally, bond zones 78 and 80 are formed in the respective mounting areas 22 and 24, providing an enlarged surface area for bonding contact with adhesive on the slips 26 and 28. It will therefore be understood that the slips 26 and 28 are both bonded to the support 10 and through the apertures 68, 70 and 72 to the house walls 18, 20.

To enhance strength of the bond, a mesh or grid 82 is provided in the aperture 68, with a similar mesh 84 in the apertures 70 and a mesh 86 in the apertures 72. Without these meshes 82, 84 and 86, in the event that the adhesive bond between the house walls 18, 20 and the slips 26, 28 in the region of the apertures 68, 70 and 72 fails, structural integrity of the quoining detail 14 could be impaired. Thus, providing the meshes 82, 84 and 86 ensures that the slips 26 and 28 will remain securely bonded to the support 10 and thus to the house 12, by virtue of mechanical fixings used to couple the structures 10 to the house 12 (which will be described below). The meshes 82, 84 and 86 are typically formed integrally during injection moulding of the panel 36, but may be nylon or glass-fibre meshes bonded to the panel 36.

As shown particularly in FIG. 1, the support 10 includes a number of fixing apertures 88, which are shaped to receive proprietary fixings (not shown) by which the supports 10 are coupled to the house 12. The fixings extend through the foam backing on the insulated panels (which will be discussed below) and which optionally engage in the existing structure of the house 1 walls. However, it will be understood that adequate fixing may be achieved by engagement purely with the material of the insulating panels. Additionally, a number of alignment markings 90 and 92 are provided around an edge of the panel 36 as cutouts, and these assist in alignment of the supports 10 during formation of the quoining details 14, and relative to indication marks provided on the house walls 18, 20.

Figure 8:
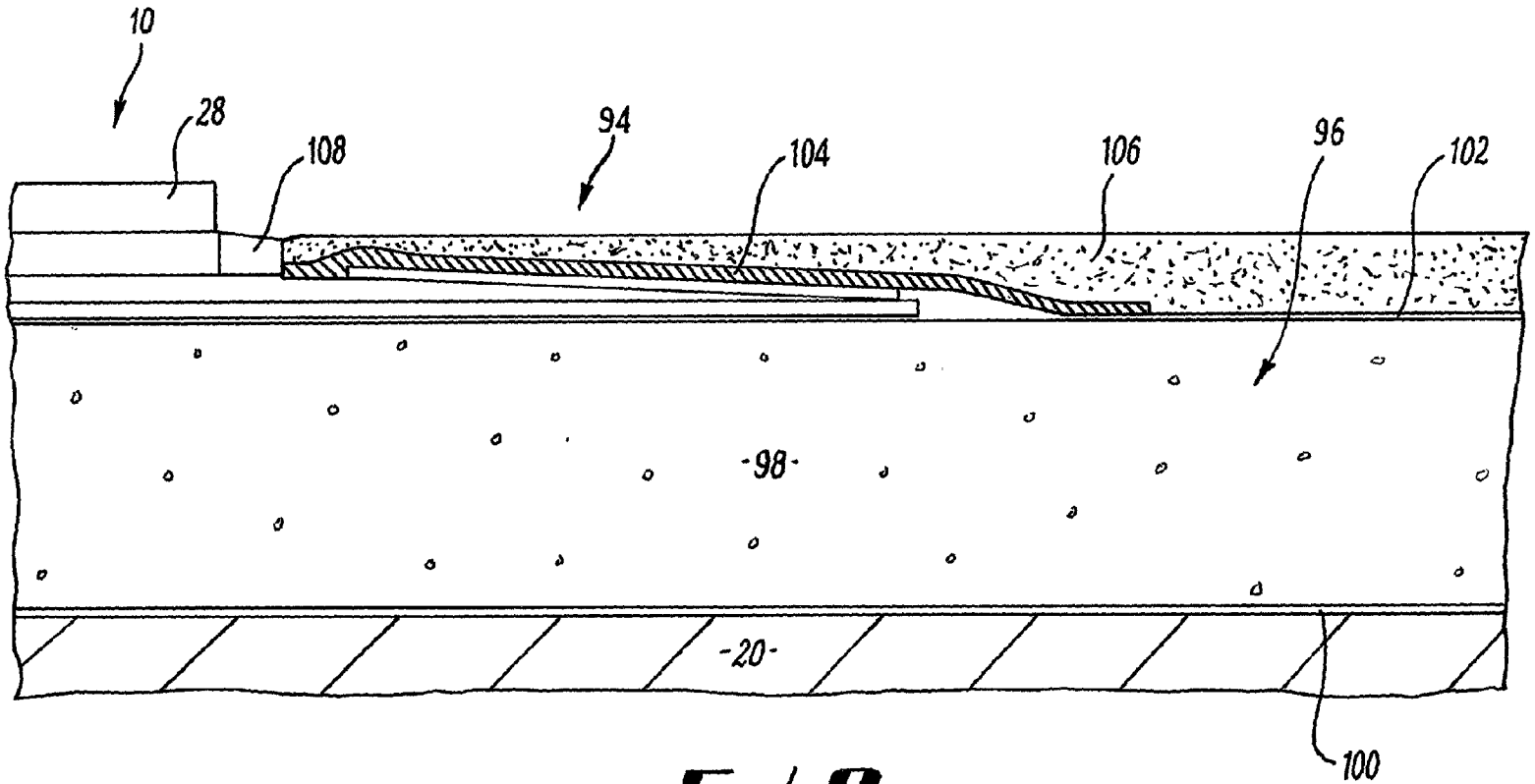
FIG. 8 is a plan sectional view of a wall of the structure of FIG. 2, showing a border region of the apparatus of FIG. 1.

Referring now also to FIG. 8, which is a partial cross-sectional view of the house side wall 20 in the region of a border 94 of the support 10, a method of forming the decorative quoining details 14 will be described in more detail.

The support 10 is in-fact designed for use with known insulated render systems, although it may be applied directly to existing house walls where a suitable decorative render finish render coating is applied. FIG. 8 shows the house wall 20, which has been clad with an External Thermal Insulation Contact System (ETICS) or Insulated Render System. This involves cladding the house walls over their entire surfaces with a number of insulation panels, one of which is shown in section in FIG. 8 and which is indicated generally by reference numeral 96. The panel 96 includes a thick (50-75 mm) insulating foam 98 and a backing sheet 100, and is secured to the house side wall 20 using suitable mechanical fixings. The supports 10 for forming each quoining detail 14 are folded as shown in FIGS. 4 and 5, and brought into position on an external surface 102 of the wall 20, which is defined by the panels 96.

The desired location of the finished quoining details 14 are then marked using the alignment markings 90 and 92, adhesive is supplied into the channels 60, and the supports are then fixed securely to the insulating panels 96 using fixings located through the fixing apertures 88. Typical fixings approved by the panel manufactures are of a plastics material and include a hollow threaded plug into which an expansion member is driven to radially expand the plug and anchor the supports 10 to the panels 96. If desired, the adhesive passages 62 may be used to temporarily locate the support 10 on the house walls, by pushing temporary pins or even screwdrivers through an aperture and into the panel on the wall, to hold the support 10 on the wall whilst the fixings are located through the apertures 88.

Figure 3:
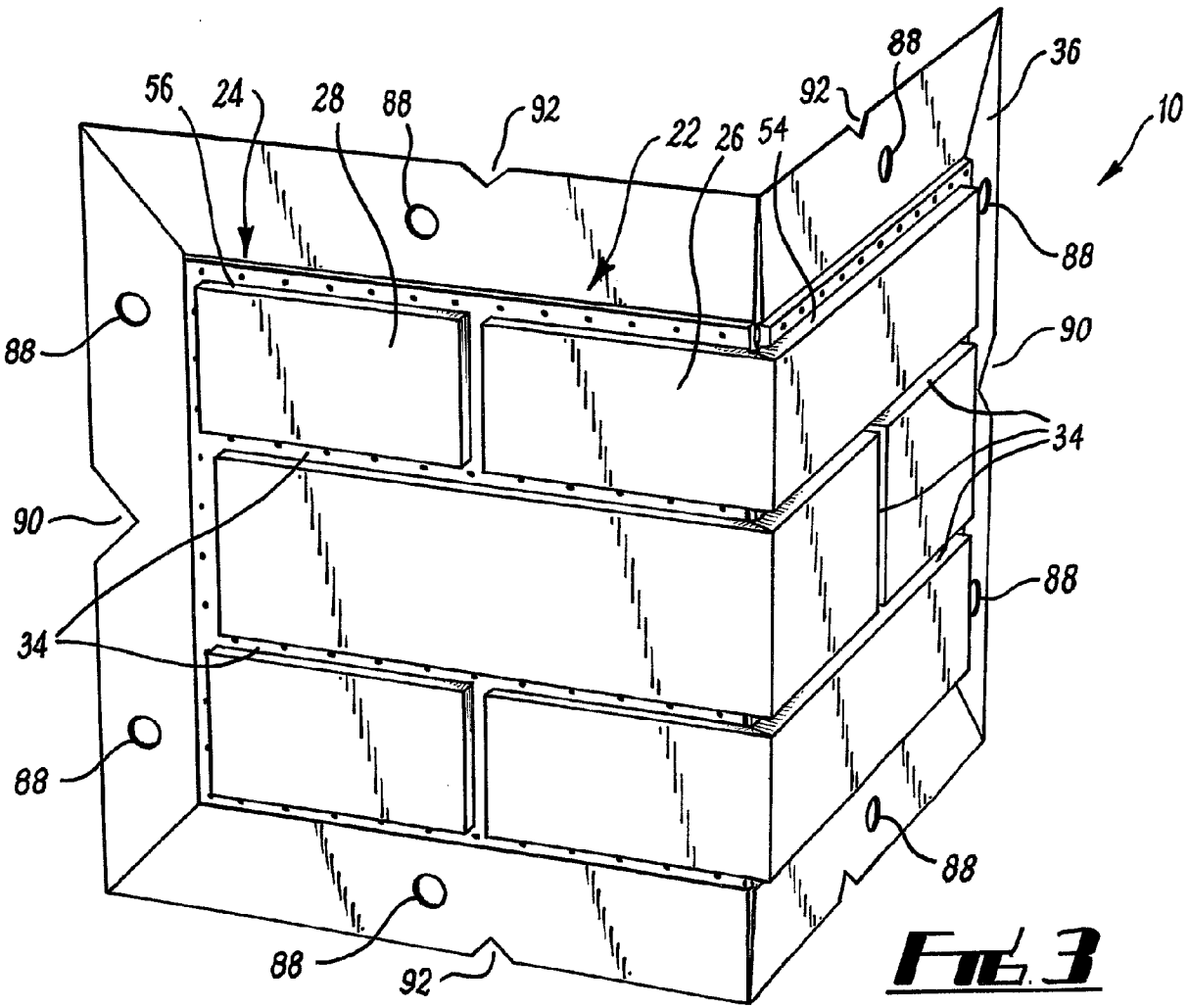
FIG. 3 is a perspective view of the apparatus shown in FIG. 1, following mounting of a number of decorative elements in mounting areas of the apparatus.

Adhesive is then applied to the rear surfaces of the slips 24 and 26, and these are mounted in the respective mounting apertures 22 and 24, as shown in FIG. 3. A tape 104 is then bonded to the supports 10, overlapping the borders 94 onto the external surfaces 102 of the panels 96, to avoid a crack forming between the support 10 and a final, decorative weatherproofing surface render 106 which is applied over the remaining surface 102. The render 106 is brought up over the border 94, which is tapered so as to avoid providing a raised profile in the finished quoining detail 14, and thus covers the tape 104. An abutment strip 108 on the panel 36 provides a stop point against which the surface render 106 is abutted, to provide a clean finish. Mortar/grout is then supplied into the channels 34 (FIG. 3) and the quoining details 14 are now complete.

Figure 19:
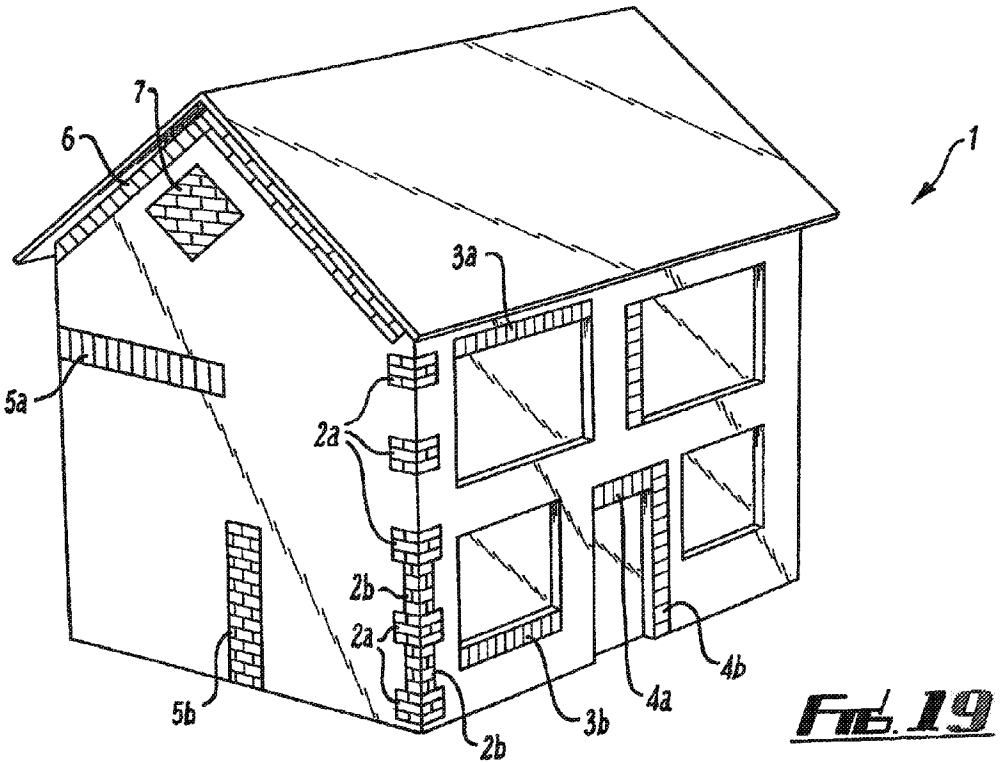
FIG. 19 Prior Art
FIG. 19 is a perspective view of a typical mid-20$^{th}$ century house in the United Kingdom.

It will be understood that other decorative features such as the window or door edging 5, 7 or lines 9 shown in FIG. 19 may be reproduced using the support 10, by appropriate shaping of the panels 36 and of the frame 38, and thus of the mounting areas 22 and 24 for the slips 26 and 28. When forming such alternative decorative features, the support may not require to be folded as described in relation to the quoining and thus may be substantially as shown in FIG. 1 when mounted on a wall. Furthermore, the panels 36 of the support 10 may be shaped appropriately for forming the desired decorative feature. For example, where a line 9 is to be formed, the border 94 of the support 10 shown in FIG. 1 may only be provided on left and right, or upper and lower edges of the panel 36, such that a continuous pattern of bricks may be replicated. In a further variation, the support may be provided without any border and the mounting apertures 88 for the fixings may be provided within the mounting areas 22/24. For example, the mounting apertures 88 may be provided in the bond zones 78/80.

Figure 9:
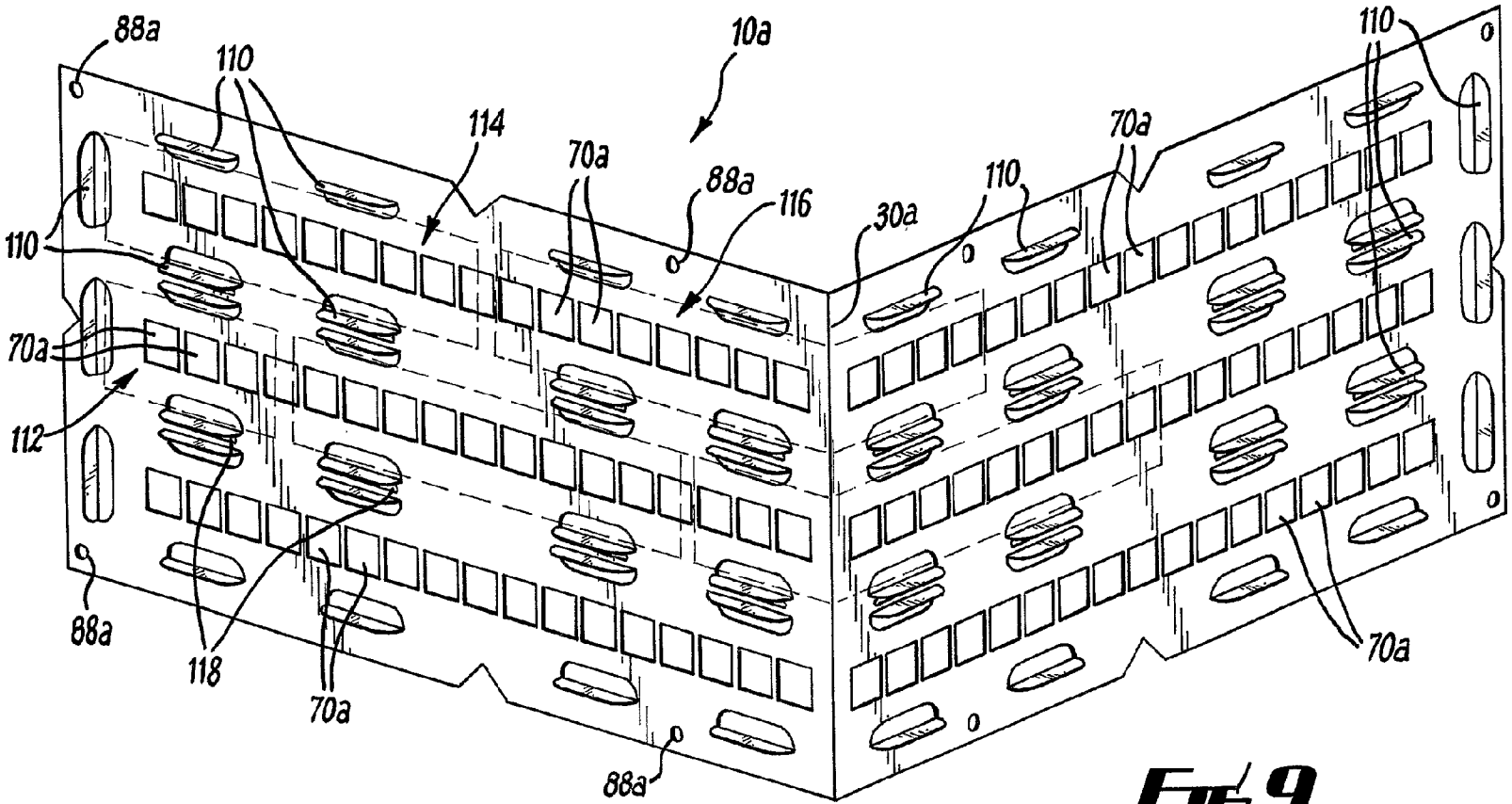
FIG. 9 is a view similar to FIG. 4 of, apparatus for use in forming a decorative feature on a structure, in accordance with a further embodiment of the present invention.

Turning now to FIG. 9, there is shown apparatus for use in forming a decorative feature on a surface of a structure in accordance with an alternative embodiment of the present invention, the apparatus indicated generally by reference numeral 10*a*. Like components of the apparatus 10*a* with the apparatus 10 of FIGS. 1 to 8 share the same reference numerals with the addition of the suffix a. As with the apparatus 10, the apparatus 10*a* is typically for use in forming a decorative feature on a building, such as the house 12 of FIG. 2. Only the differences between the apparatus 10*a* and the apparatus 10 will be described herein in detail.

The apparatus 10*a* comprises a support manufactured from a sheet of metal such as an aluminium plate, which has a matte or non-slip surface, to provide a good key for the slips. The plate is punched in a number of locations to form mounting elements in the form of tabs or protrusions 110, and these mounting tabs 110 define mounting areas for receiving decorative slips, similar to the clay slips 26 and 28 shown in FIG. 3. Indeed, the mounting tabs 110 define some of the borders of the mounting area in question (top and bottom, or top, bottom and one end).

In the illustrated embodiment, a number of different mounting areas are defined ranging from half-brick mounting areas 112, full brick mounting areas 114 and L-shaped mounting areas 116, as shown by the dashed lines in the Figure. It will be understood that location of appropriately sized slips (not shown) in the respective mounting areas 112, 114 and 116 enables a quoining detail similar to that shown in FIG. 3 to be formed, when the support is mounted on the house walls 18, 20. A number of apertures 70 are also punched in the metal sheet, and these provide for bonding of the slips to the external surface of an insulating panel, such as the panel 96 shown in FIG. 8, or indeed external surfaces of the house walls 18, 20.

The mounting tabs 110 provided in a middle row of slip mounting areas are spaced apart to define channels for receiving a pointing grout or mortar, and the metal plate is also punched to form grout apertures 118. These grout apertures 118 provide a further enhanced bond between the support structure 10*a* and the insulating panel. The extent to which the mounting tabs 110 protrude from the external surface of the support structure 10*a* is dependent upon the width of the slips to be mounted on the support structure. Each of the tabs 110 may include a slot, channel or aperture (not shown) for accommodating mortar, to provide a bond with the respective slip.

The support structure 10*a* is mounted on the house walls 18, 20 in a similar fashion to the support structure 10, using an adhesive and fixings (not shown) secured through fixing apertures 88*a*, and with the slips coupled to the structure 10*a* using a suitable adhesive.

Figure 10:
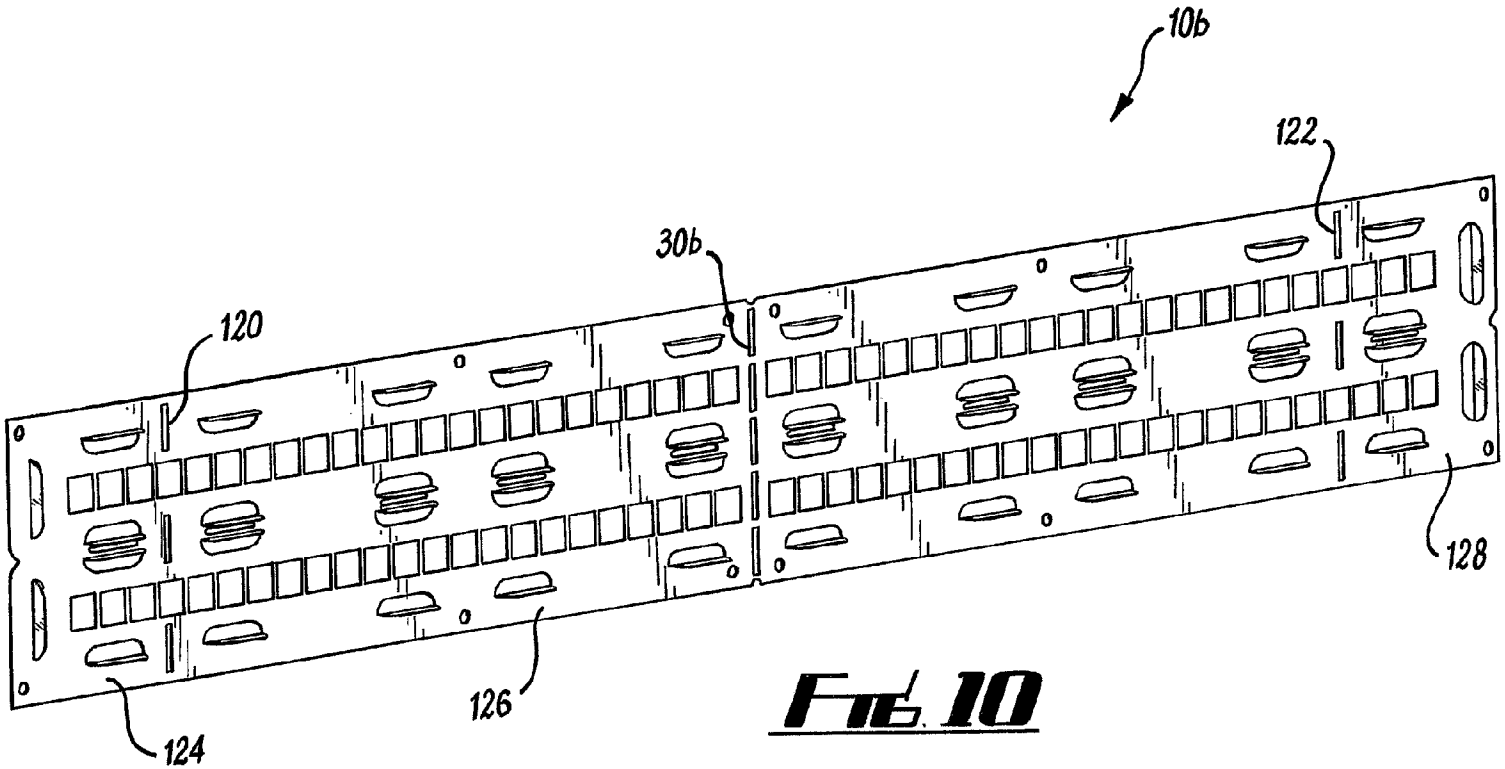
FIG. 10 is a perspective view of apparatus for use in forming a decorative feature on a structure, in accordance with a still further embodiment of the present invention.

Turning now to FIG. 10, there is shown apparatus for use in forming a decorative feature on a surface of a structure in accordance with an alternative embodiment of the present invention, the apparatus indicated generally by reference numeral 10*b*. Like components of the apparatus 10*b* with the apparatus 10 of FIGS. 1 to 8 share the same reference numerals with the addition of the suffix b, and with the support structure shown in FIG. 9, share the same reference numerals with the suffix a replaced by the suffix b.

The support structure 10*b* is in fact of very similar construction to the support structure 10*a*, save that the structure is of different dimensions and is shown in the Figure in an unfolded configuration. It will be understood that the structure 10*b* is provided flat-packed, and may be folded along a fold line 30*b* to form a quoining detail, or may be provided in the illustrated configuration to form a strip or line feature.

The support structure 10*b* includes frangible joints or tear-strips 120, 122 which permit the support structure 10*b* to be separated into independent sections 124, 126 and 128. It will therefore be understood that a basic support structure may be provided which can be adapted by a user to form a decorative feature of a desired shape and size, by providing a support structure including such frangible joints 120, 122. Accordingly, further frangible joints (not shown) may be provided in the support structure 10*b*, permitting separation into smaller individual sections, which can then be built-up to form any desired or suitable decorative feature. These include, but are not limited to, the features 2*a*, 2*b*, 3*a*, 3*b*, 4*a*, 4*b*, 5*a*, 5*b*, 6 and 7 shown in FIG. A. Further details of the support structure 10*b*, its construction and method of mounting to a structure such as the house 12 of FIG. 2, are common with the method described above in relation to the structure 10*a* of FIG. 9.

Figure 11:
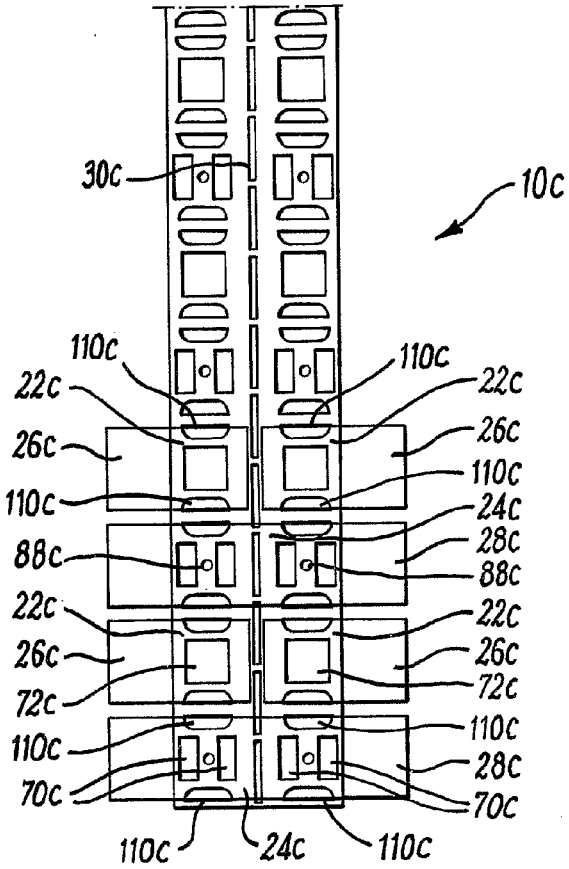
FIG. 11 is a front view of part of apparatus for use in forming a decorative feature on a structure, in accordance with a yet further alternative embodiment of the present invention.

Turning now to FIG. 11, there is shown a front view of part of an apparatus for use in forming a decorative feature on a structure in accordance with a further alternative embodiment of the present invention, the apparatus indicated generally by reference numeral 10*c*. Like components of the apparatus 10*c* with the apparatus 10 of FIGS. 1 to 8 share the same reference numerals with the addition of the suffix c. Also, like components of the apparatus 10 with the apparatus 10*a* and 10*b* of FIGS. 9 and 10 share the same reference numerals with the suffix a/b replaced by the suffix c.

The apparatus 10*c* is in fact of similar construction to the apparatus 10*a* and 10*b*, and takes the form of a support, only part of which is shown in the Figure, for mounting slips 26*c* and 28*c* on a building to form a decorative feature. The support 10*c* has a number of mounting areas 22*c* and 24*c* for the slips 26*c* and 28*c*, the mounting areas defined by mounting elements in the form of tabs 110*c*. As will be understood from the following description, the tabs 110*c* define some of the borders of the mounting areas 22*c*, 24*c*.

It will be understood that the support 10*c* is of a length suitable for forming a feature of desired dimensions, and may be cut to size and/or aligned with adjacent supports as necessary. The slips 26*c* and 28*c*, when mounted on the support 10*c*, extend beyond the side edges of the support, and thus overhang the support. Typically, a number of the supports 10*c* are arranged side-by-side on the building surface, and the slips 26*c* and 28*c* extend across from one support 10*c* to an adjacent support, the slips received in similar mounting areas on the adjacent support. In this fashion, a number of the supports 10*c* may be provided together to form a desired decorative feature over a large surface area of a building.

The support 10*c* also has a particular utility in forming edge or quoining details on a building, such as the features 2*a*, 2*b*, 3*b*, 4*a* and 4*b* shown in FIG. 19. To facilitate this, the support 10*c* includes a hinge 30*c* defined by apertures in the support, which permit the support to be bent for location around a corner. Suitable angled slips, such as the slips 26 of FIG. 3, would then be mounted on the support 10*c* extending around the building corner in question.

It will be understood that the support 10*c* may also be provided in combination with alternative supports, of types described herein, to form a feature of desired shape/dimensions. Furthermore, the support 10*c* may be utilised to form vertical or horizontal lines on a building, such as the lines 5*a* and 5*b* shown in FIG. 19.

Further features of the support 10*c* are as follows. The support 10*c* includes apertures 70*c* in the mounting areas 24*c*, and apertures 72*c* in the mounting areas 22*c*, which facilitate direct bonding of the slips 24*c*, 26*c* to the surface of the building. Additionally, fixing apertures 88*c* are provided for mounting the support 10*c* on the building surface.

Figure 12:
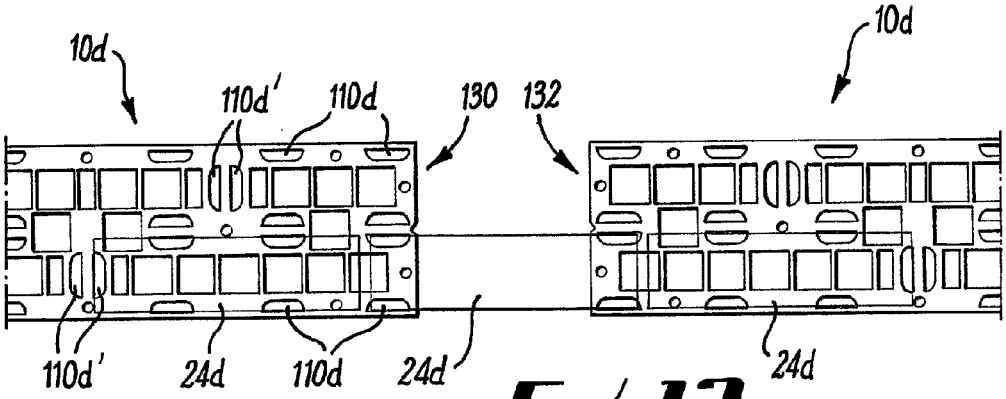
FIG. 12 is a front view of parts of apparatus for use in forming a decorative feature on a structure in accordance with a yet further alternative embodiment of the present invention.

Turning now to FIG. 12, there are shown front views of parts of apparatus for use in forming a decorative feature on a structure in accordance with a further alternative embodiment of the present invention, the apparatus indicated generally by reference numeral 10*d*. Like components of the apparatus 10*d* with the apparatus 10 of FIGS. 1 to 8 share the same reference numerals with the addition of the suffix d. Also, like components of the apparatus 10 with the apparatus 10*a*, 10*b* or 10*c* of FIGS. 9 to 11 share the same reference numerals with the suffixes replaced by the suffix d.

The apparatus 10*d* takes the form of a support which is most alike to the support 10*a* of FIG. 9. However, end regions 130 and 132 of the support 10*d* permit the mounting of slips 24*d* extending across from one support 10*d* to an adjacent such support, as shown in the Figure. This is achieved by omitting the vertical tabs 110 of the support 10*a*. By providing a structure where the slips 24*d* may be 'bridged' across the supports 10*d* in this fashion, a desired surface area of the building can be covered with fewer supports than would be necessary were they provided immediately adjacent one-another, saving in material costs. It will be understood that the slips 24*d* which overlap the ends 130 and 132 of the supports 10*d* are mounted directly on to the building or insulating panel surface using a suitable adhesive.

Further features of the support 10*d* are alike to the support 10*a*, save that the support 10*d* includes a number of vertically (in use) aligned tabs 110*d*' which facilitate location of the slips 24*d* on the support and formation of slip patterns such as the stretcherbond pattern described above. Thus some of the sets of tabs 110*d*/110*d*' define all of the borders of the mounting areas, whilst others only define some of the borders.

Figure 13:
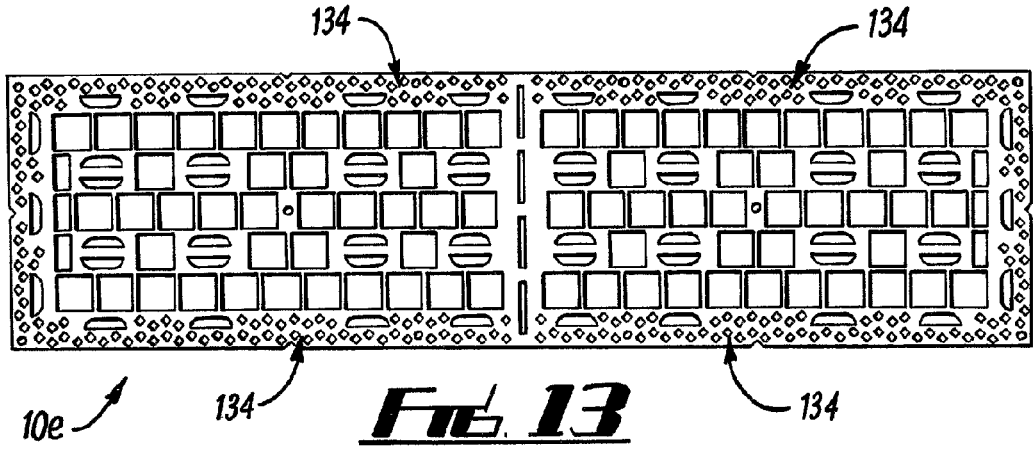
FIG. 13 is a front view of apparatus for use in forming a decorative feature on a structure in accordance with a yet further alternative embodiment of the present invention.

Turning now to FIG. 13, there is shown a front view of apparatus for use in forming a decorative feature on a structure in accordance with a further alternative embodiment of the present invention, the apparatus indicated generally by reference numeral 10*e*. The apparatus 10*e* is in fact of similar construction to the apparatus 10*a* of FIG. 9, and only the differences will be described herein in detail. Like components of the apparatus 10*e* with the apparatus 10 of FIGS. 1 to 8 share the same reference numerals with the addition of the suffix e. Also, like components of the apparatus 10*e* with the apparatus 10*a* share the same reference numerals with the suffix a replaced by the suffix e.

The apparatus 10*e* takes the form of a support 10*e*. To assist in achieving a good final bond of the support 10*e* on the building surface, a border region 94*e* of the support 10*e* includes a large number of bonding apertures, which allow the flow of a render top coat to pass through the openings.

Figure 14:
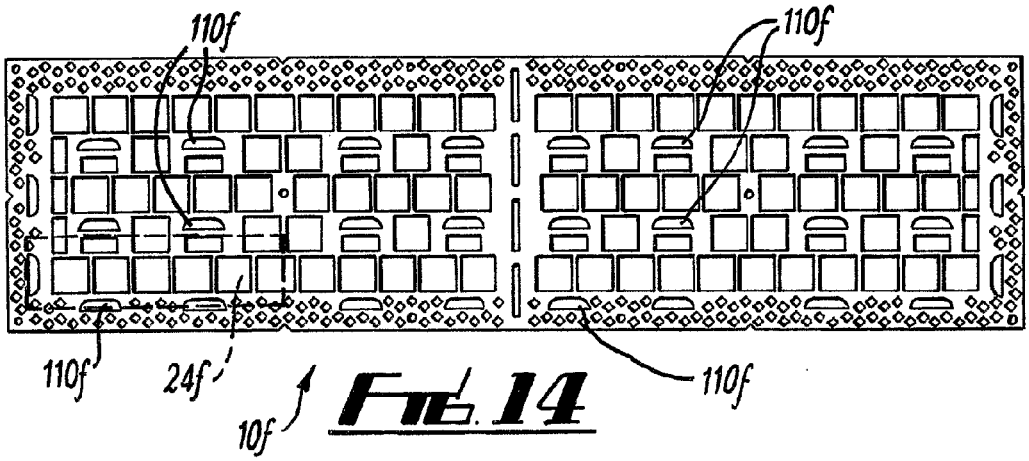
FIG. 14 is a front view of apparatus for use in forming a decorative feature on a structure in accordance with a yet further alternative embodiment of the present invention.

Turning now to FIG. 14, there is shown a front view of apparatus for use in forming a decorative feature on a structure in accordance with a further alternative embodiment of the present invention, the apparatus indicated generally by reference numeral 10*f*. The apparatus 10*f* is in fact of similar construction to the apparatus 10*e* of FIG. 13, and only the differences will be described herein in detail. Like components of the apparatus 10*f* with the apparatus 10 of FIGS. 1 to 8 share the same reference numerals with the addition of the suffix f. Also, like components of the apparatus 10*f* with the apparatus 10*e* share the same reference numerals with the suffix e replaced by the suffix f.

The apparatus 10*f* takes the form of a support 10*f*. The support 10*f* includes horizontal (in use) tabs 110*f* which retain slips on the support. One such slip 24*f* is shown in broken outline. The tabs 110*f* are arranged such that a slip 24*f* in a lower row abuts a lower surface of a tab 110*f* in an upper row. Accordingly, by doing away with opposed pairs of tabs, to provide a separation for locating grout or a finishing trim, the slips themselves define the entire finished surface of the decorative feature. Thus no finishing grout or trim is required. This is of particular utility, for example, where wooden, plastics or metal slips are to be mounted (or simulated wood or metal slips).

Figure 15:
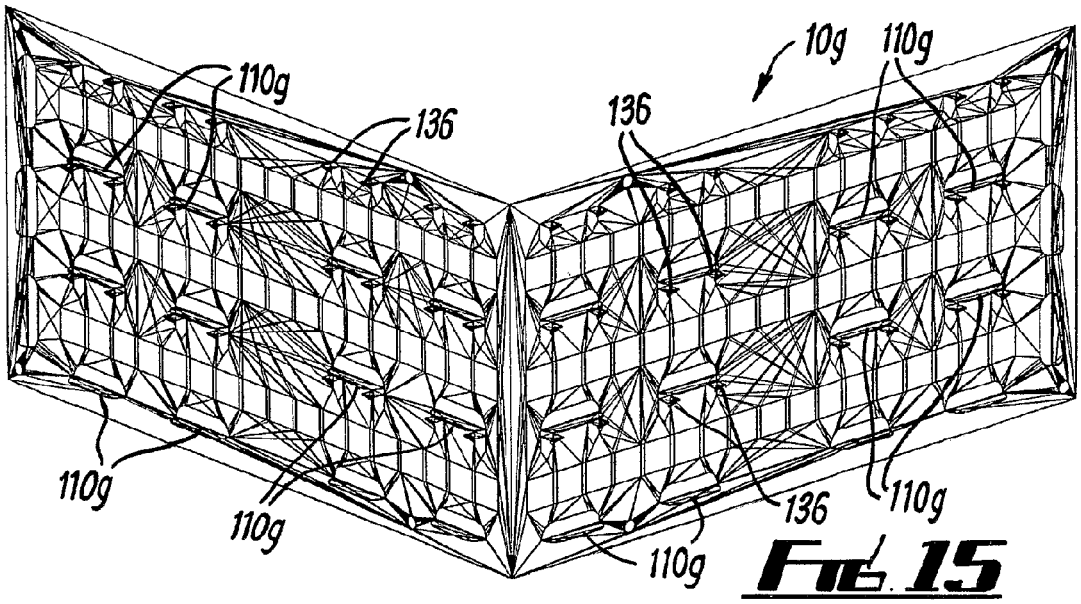
FIG. 15 is a perspective view of apparatus for use in forming a decorative feature on a structure in accordance with a yet further alternative embodiment of the present invention.

Turning now to FIG. 15, there is shown a perspective view of apparatus for use in forming a decorative feature on a structure in accordance with a further alternative embodiment of the present invention, the apparatus indicated generally by reference numeral 10*g*. The apparatus 10*g* is in fact of similar construction to the apparatus 10*a* of FIG. 9, and only the differences will be described herein in detail. Like components of the apparatus 10*g* with the apparatus 10 of FIGS. 1 to 8 share the same reference numerals with the addition of the suffix g. Also, like components of the apparatus 10*g* with the apparatus 10*a* share the same reference numerals with the suffix a replaced by the suffix g.

The apparatus 10*g* takes the form of a support, and includes a number of horizontal (in use) tabs 110*g*, which support lower edges of slips (not shown) mounted in the support 10*g*. A number of pairs of mounting elements in the form of smaller, shaped tabs 136 are provided for retaining upper edges of the slips. These tabs 136 each are best seen in FIG. 16, which is an enlarged perspective view, and include a base section 138 and a generally triangular deformable portion 140, disposed at an angle to the base section 138. In use, when a slip is mounted on the support 10*g*, the support comes into contact with the deformable portion. As the slip is pushed into the mounting area, the slip causes the portion 140 to deform and bend. The portion 140 is resiliently deformable, to provide an engaging force against an upper top surface of the slip, to retain the slip in the support 10*g*.

The mounting tabs 136 are of a particular utility where hand-crafted slips are to be mounted in the support 10*g*, as the tabs allow slips of varying dimensions to be inserted into the carrier without a separate binding element. Typical such slips include hand made stone or clay slips that naturally have uneven edges or variations in other dimensions from slip to slip. The tabs 136 therefore provide a degree of tolerance for locating slips in the support 10*g*.

Turning now to FIG. 17, there is shown a perspective view of a locating member in the form of an elongate bead 140, for use with any of the supports 10*a* to 10*g* described above. The bead 140 is typically of a moulded plastics material, and includes a base portion 142 which is generally L-shaped in cross-section. The base portion 142 sits within a mounting aperture of a support (not shown). A smaller L-shaped portion 144 is provided back-to-back with the base portion 142, and defines a narrow channel 146 therebetween. Finally, an arcuate lip 148 extends from a lower end of the portion 144.

The bead 140 is located over a number of mounting tabs of the respective support, the tabs received within the channel 146. The channel 146 is dimensioned to provide a tight fit on the tabs. A slip, such as the slip 24*f* of FIG. 14 (shown in broken outline), is located upon the base portion 142, and engagement between the mounting tabs, the bead 140 and the slip 24*f* retains the slip in the support. When all the slips have been attached and pointed (if required), a render coat 106*f* is applied and extends up over and under the lip 148. On curing, this provides a secure bond to hold the bead, and thus the support and thereby the slip 24*f*, in place on the building surface.

Turning finally to FIG. 18, there is shown an end view of a locating member in the form of an elongate bead 140*h*, for use with any of the supports 10*a* to 10*g* described above. The bead 140*h* is of similar structure to the bead 140 of FIG. 17, and like components share the same reference numerals with the addition of the suffix h.

The bead 140*h* includes a base portion 142*h* on which a slip (not shown) sits, and a further L-shaped portion 144*h*, defining a channel 146*h* in which support mounting tabs are received. The bead 140*h* differs from the bead 140 in that it includes an alternative lip 150 having an edge section 152. In use, render 106*h* comes up under the edge section 152 to secure the bead 140*h* in a similar fashion to that described above. However, the lip 150 has a decorative upper surface 154 which is flush with the slips and visible on completion of the rendering work. Depending upon the desired finish, the surface 154 may, for example, provide a wood grain, plastics, metal, stone or brick effect finish.

The above described supports 10 to 10*g*, and the described methods, offer various advantages over conventional structures and methods. In particular, the ability to apply insulating panels over the entire surface of the walls 18 and 20 of the house 12 prior to formation of the quoining details 14 greatly speeds the installation process, and reduces material wastage.

Various modifications may be made to the foregoing without departing from the spirit and scope of the present invention.

For example, it will be understood that the support may be utilised to form any desired decorative feature, and thus ones which are not based on replicating patterns which may be formed using conventional bricks. Thus tiles, stones, fake stones or the like may be mounted in the support and the mounting areas shaped appropriately. Other decorative elements such as timber, plastics (or other synthetic material), or metal boards/strips, lighting tracks or the like may by provided and may be coupled to the support. One or more dimensions, in particular, a thickness of the support 10 may be varied according to a desired final appearance of the decorative feature to be formed, or indeed by a variation of the thickness of the decorative building elements.

Where a real stone material is to be utilised in a quoining detail such as that described above, stones to be placed extending around the building corner (alike to the slips 26, which are often known as 'pistols') are replicated utilising two separate stone pieces. These may be abutted at a corner of the support to provide a clean finish, or a strip or the like may be located at the intersection between the two pieces. The support may be shaped to receive the strip or the like and optionally to engage the strip.

Although the invention is shown with decorative features in the form of brick quoining details and with a remainder of a surface of the building covered with a render finish, it will be understood that the quoining details may carry a render finish and the remainder of the building a brick finish. This may also be the case where finishes other than brick (such as stone) are to be reproduced.

The supports may include engaging elements of any suitable shape/size and thus may include tongue-and-groove type elements.

Alternative patterns such as stackbond or herringbone patterns may be formed.

A decorative building element to be coupled to the support may carry additional insulation and/or adhesive such as a foam pad with an adhesive backing, which may include a backing strip that can be removed to expose the adhesive, for coupling the building element to the support.

The invention claimed is:

1. A decorative feature installation apparatus provided on a building, the apparatus comprising:

at least one decorative element;

at least two supports mounted on a surface of the building, each support having a planar outer face for receiving a decorative element, for thereby mounting the decorative element at the surface of the building to form a decorative feature;

and at least one set of mounting elements provided on the outer face of each support;

wherein the mounting elements define at least one border of the decorative element to facilitate positioning of the decorative element on the support outer face;

and wherein each support has at least one aperture which is configured to allow direct bonding of the decorative element to both the support and the surface of the building;

and wherein each support includes a mesh which is adapted to extend across each at least one aperture to strengthen the bond between the decorative element and the support;

and wherein each support is adapted to cooperate with a set of mounting elements in an adjacent support for mounting a decorative element on the surface of the building, and wherein the two supports are spaced apart such that at least one decorative element bridges across the two supports;

and wherein the apparatus includes a plurality of locating members, each locating member adapted to be mounted on an at least one mounting element and to cooperate with a decorative element, for facilitating mounting of the decorative element on the support.

2. Apparatus as claimed in claim 1, wherein the mounting elements in each at least one set together define at least one mounting area on the support outer face, which mounting area is shaped to receive a decorative element.

3. Apparatus as claimed in claim 1, wherein the apparatus is for use in forming a decorative simulated brick feature on the surface of the building.

4. Apparatus as claimed in claim 1, wherein the decorative element comprises a brick slip or a tile.

5. Apparatus as claimed in claim 1, wherein the mounting elements define a lower border of the decorative element to facilitate vertical positioning of the decorative element on the support outer face.

6. Apparatus as claimed in claim 1, wherein the mounting elements define a continuous longitudinal border of the decorative element.

7. Apparatus as claimed in claim 1, wherein the mounting elements are spaced apart so as to provide a channel between adjacent decorative elements.

8. Apparatus as claimed in claim 7, wherein the channel is a horizontally extending channel.

9. Apparatus as claimed in claim 1, wherein the support comprises a frame defining the mounting elements.

10. Apparatus as claimed in claim 1, wherein the support comprises at least one recess in the outer face thereof, side walls of the recess defining the mounting elements.

11. Apparatus as claimed in claim 9, comprising a plurality of walls extending in a direction transverse to a main plane of the support, the walls defining a border of the at least one mounting area.

12. Apparatus as claimed in claim 9, wherein the frame has walls adapted to receive and engage the decorative element in an interference fit.

13. Apparatus as claimed in claim 12, wherein at least part of at least one wall of the frame is inclined to provide a push-fit engagement with the decorative element.

14. Apparatus as claimed in claim 1, comprising a plurality of apertures, at least one for each decorative element to be used to form the decorative feature.

15. Apparatus as claimed in claim 1, wherein the aperture is shaped such that, in use, the decorative element overlaps borders of the aperture to facilitate bonding of the decorative element to the apparatus.

16. Apparatus as claimed in claim 15, wherein the locating member comprise a lip portion adapted to overlie an edge of the support and to interact with a coating applied to the building surface, for facilitating mounting of the support on the surface of the building.

17. Apparatus as claimed in claim 15, wherein the locating member comprises a portion adapted to receive a decorative element, for securing the locating member to the at least one mounting element and thus to the support.

18. Apparatus as claimed in claim 1, comprising a plurality of adhesive passages extending between an internal and an external surface thereof, to facilitate bonding of the apparatus to the building surface by permitting flow of a mounting adhesive through the passages from the internal to the external surface.

19. Apparatus as claimed in claim 1, comprising at least one channel on an internal surface thereof, the channel being for receiving an adhesive used to bond the support to the building surface.

20. Apparatus as claimed in claim 1, wherein the apparatus is foldable, to facilitate formation of a decorative feature extending around a corner of the building.

21. Apparatus as claimed in claim 1, wherein the support is modular and comprises a plurality of support sections, each support section defining an at least one mounting area.

22. Apparatus as claimed in claim 21, wherein the support sections are coupled by a frangible joint.

23. Apparatus as claimed in claim 1, comprising at least one alignment marker for facilitating alignment with at least one of a further apparatus; an existing feature of a building; and a locating mark formed on a wall of a building.

24. Apparatus as claimed in claim 1, comprising an engaging element for coupling the support to a further such support.

* * * * *